US008608871B2

(12) United States Patent
Ishiguro et al.

(10) Patent No.: US 8,608,871 B2
(45) Date of Patent: Dec. 17, 2013

(54) HIGH-STRENGTH STEEL TUBE HAVING EXCELLENT CHEMICAL CONVERSION TREATABILITY AND EXCELLENT FORMABILITY AND METHOD FOR MANUFACTURING THE SAME

(75) Inventors: Yasuhide Ishiguro, Chiyoda-ku (JP); Akio Sato, Chiyoda-Ku (JP); Yasuhisa Shimizu, Wako (JP)

(73) Assignees: JFE Steel Corporation, Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/123,087

(22) PCT Filed: Oct. 7, 2009

(86) PCT No.: PCT/JP2009/067821

§ 371 (c)(1),
(2), (4) Date: Jun. 29, 2011

(87) PCT Pub. No.: WO2010/041763

PCT Pub. Date: Apr. 15, 2010

(65) Prior Publication Data

US 2011/0247715 A1 Oct. 13, 2011

(30) Foreign Application Priority Data

Oct. 8, 2008 (JP) ..... 2008-262062

(51) Int. Cl.

| | |
|---|---|
| ***C21D 8/10*** | (2006.01) |
| ***C22C 38/02*** | (2006.01) |
| ***C22C 38/04*** | (2006.01) |
| ***F16L 9/00*** | (2006.01) |
| ***B21C 37/06*** | (2006.01) |

(52) U.S. Cl.
USPC ..... 148/320; 148/519; 148/590; 148/593; 148/909; 72/368; 138/177

(58) Field of Classification Search
USPC ..... 148/519, 590, 593, 320, 909; 138/177; 72/368
See application file for complete search history.

(56) References Cited

U.S. PATENT DOCUMENTS

2003/0008171 A1* 1/2003 Toyooka et al. ..... 428/683

FOREIGN PATENT DOCUMENTS

| | | |
|---|---|---|
| JP | 466327 | 2/1971 |
| JP | 62116723 | 5/1987 |

(Continued)

OTHER PUBLICATIONS

Tamai and Mori, Kinzoku Hyomen Gijutsu (The Journal of the Metal Finishing Society of Japan), vol. 31, (1980), pp. 482-486.

(Continued)

*Primary Examiner* — Deborah Yee
(74) *Attorney, Agent, or Firm* — RatnerPrestia

(57) ABSTRACT

There is provided a high-strength steel tube having excellent chemical conversion treatability and excellent formability and a method for manufacturing the high-strength steel tube. More specifically, in processing a mother steel sheet containing, on the basis of mass percent, 0.05% or more C, more than 0.7% Si, and 0.8% or more Mn into a pipe shape, the sum total of absolute circumferential surface strains each applied in individual process steps of the processing is 5% or more as nominal strain. A welded steel tube thus manufactured using a steel sheet even containing more than 0.7% Si can have excellent chemical conversion treatability without mechanical grinding or chemical pickling treatment.

12 Claims, 4 Drawing Sheets

(56) References Cited

FOREIGN PATENT DOCUMENTS

| | | |
|---|---|---|
| JP | 7278730 | 10/1995 |
| JP | 2002226944 | 8/2002 |
| JP | 2003049246 | 2/2003 |
| JP | 2003226920 | 8/2003 |
| JP | 2004256896 | 9/2004 |
| JP | 2004292926 | 10/2004 |
| JP | 2004323969 | 11/2004 |
| JP | 2005187863 | 7/2005 |
| JP | 2005248281 | 9/2005 |
| JP | 2005281787 | 10/2005 |
| JP | 2005290440 | 10/2005 |
| JP | 2006144106 | 6/2006 |

OTHER PUBLICATIONS

Suda et al., Tetsu to Hagane (Bulletin of the Iron and Steel Institute of Japan), vol. 66, (1980), pp. S1130.

International Search Report dated Nov. 24, 2009, application No. PCT/JP2009/067821.

* cited by examiner (a)

(b) AFTER PEELING

HIGH-STRENGTH STEEL TUBE HAVING EXCELLENT CHEMICAL CONVERSION TREATABILITY AND EXCELLENT FORMABILITY AND METHOD FOR MANUFACTURING THE SAME

CROSS-REFERENCE TO RELATED APPLICATIONS

This application is the U.S. National Phase application of PCT International Application No. PCT/JP2009/067821, filed Oct. 7, 2009, and claims priority of Japanese Patent Application No. 2008-262062, filed Oct. 8, 2008, the disclosures of which PCT and priority applications are incorporated herein by reference in their entirety for all purposes.

FIELD OF THE INVENTION

The present invention relates to a high-strength steel tube that received chemical conversion treatment and baking painting and can be mainly used in the field of automotive members and, more particularly, to improvement in the chemical conversion treatability of a high-strength steel tube having a high Si content of more than 0.7% by mass Si.

BACKGROUND OF THE INVENTION

In recent years, from the standpoint of global environmental protection, efforts have been made to reduce the weight of automotive bodies and improve the mileage of automobiles. The improvement in the mileage of automobiles has also been required by law. Recently, efforts have been made to use high-strength materials as the materials for automotive body to reduce the weight of automobiles by gauge down (thickness reduction). Furthermore, improvement in the stiffness of members using a closed-cross-section structure is under study. In response to the improvement in the stiffness of automotive members, high-strength steel tubes began to be used.

As in steel sheets, such high-strength steel tubes are essentially required to be easy to process and have excellent chemical conversion treatability. In general, high-strength steel tubes are basically designed to contain 0.7% by mass or more Si to achieve both high strength and excellent formability. However, the inclusion of Si is inevitably accompanied with a marked deterioration in chemical conversion treatability. The mechanism of deterioration in the chemical conversion treatability of steel materials having a high Si content is known to some extent as described below.

In steel materials containing Si, an oxide mainly composed of Si is concentrated on a surface layer of the steel material (other equivalent expressions, such as a Si-based oxide, a Si-containing oxide, a Si oxide, and a Si group oxide, mean the same oxide; unless otherwise specified, these are collectively referred to as an oxide mainly composed of Si). An oxide mainly composed of Si prevents Fe in a base steel material from uniformly dissolving as $Fe^{2+}$ and inhibits the formation of iron-zinc phosphate crystals ($Zn_2Fe(PO_4)_2.4H_2O$) in the anode reaction and cathode reaction during chemical conversion treatment. Thus, dense and fine iron-zinc phosphate crystals cannot be formed on the steel material. As illustrated in FIG. 1, the chemical conversion treatment of high-Si steel results in the formation of iron-zinc phosphate crystals having coarse and sparse iron-zinc phosphate crystal-free areas (hereinafter referred to as crystal-free areas). In contrast, as illustrated in FIG. 2, the chemical conversion treatment of mild steel having a low Si content (JIS-SPCC-grade steel sheets) forms very dense iron-zinc phosphate crystals.

In cold-rolled steel sheets, pickling of a hot-rolled steel sheet before cold rolling can partly remove an oxide mainly composed of Si. However, in cold-rolled steel sheets subjected to an annealing process, such as continuous annealing or batch annealing, after cold rolling, an oxide mainly composed of Si is again inevitably concentrated on a surface layer in a furnace even at a very low dew point. Thus, cold-rolled steel sheets also often have poor chemical conversion treatability. Furthermore, in the annealing process, gradual variations in the environment within the furnace, variations in the components of steel, or variations in manufacturing conditions often result in variations in the distribution of an oxide mainly composed of Si from one coil to another in the longitudinal and width directions of the coil. In the formation of an oxide mainly composed of Si, variations in the components of steel, variations in manufacturing conditions, and the like intricately interact with one another. It is therefore difficult to manage these influencing factors to control chemical conversion treatability.

Thus, the surfaces of steel sheets manufactured have hitherto been ground in a mechanical process or dissolved in a chemical process, such as pickling, to remove an oxide mainly composed of Si that inhibits chemical conversion. For example, PTL 1 describes a method for manufacturing high-tensile steel sheets with a high Si content having excellent phosphate coating treatability. This method includes annealing in an atmosphere in which the oxygen partial pressure is controlled within a particular range, quenching in a particular temperature range, grinding of the surface, and pickling to remove an oxide film.

PTL 3 describes a method for manufacturing high-strength cold-rolled steel sheets having excellent chemical conversion treatability. This method includes softening and annealing of cold-rolled steel sheets having a (Si content)/(Mn content) of 0.4 or more in an atmosphere at a dew point in the range of −20° C. to 0° C. such that the fraction of surface coverage of a Si group oxide is 20% or less and the equivalent circular diameter of the Si group oxide is 5 μm or less, water quenching, tempering, and immersion in hydrochloric acid or sulfuric acid for pickling.

PTL 12 describes a method for manufacturing high-strength electric-resistance-welded steel tubes having excellent chemical conversion treatability. This method includes hot-rolling and pickling of a steel sheet having a composition of Si: 0.5% by mass or less, Mn: 1.5% by mass or less, and P: 0.05% by mass or less to remove an outer surface layer and an inner surface layer, cold rolling at a cold-rolling reduction in the range of 10% to 60%, and electric-resistance welding (ERW) of both ends of the cold-rolled steel strip in the width direction to form a welded steel tube.

However, grinding or pickling requires a large number of man-hours, and it is difficult to completely remove an oxide mainly composed of Si. Furthermore, an oxide mainly composed of Si is glass and consequently does not dissolve in a common acid, such as hydrochloric acid or sulfuric acid. Furthermore, since an oxide mainly composed of Si cannot be selectively removed by pickling, a base steel sheet must be significantly dissolved to remove the oxide mainly composed of Si.

PTL 2 describes a method for treating a steel surface, which includes immersion of a steel material in a mixed acid of sulfuric acid and hydrofluoric acid at a sulfate ion concentration and a hydrogen fluoride concentration in particular ranges and subsequent immersion of the steel material in hydrochloric acid at a chloride ion concentration in a particular range. Although pickling in a fluorinated acid type agent can completely remove an oxide mainly composed of Si, use of the fluorinated acid type agent may somewhat increase the degree of danger.

PTLs 4 to 8 describe a technique for improving chemical conversion treatability by forming a Si—Mn composite oxide easily soluble in an acid while preventing the formation of a slightly soluble oxide mainly composed of Si.

PTL 4 describes a multiphase steel sheet having excellent coating adhesion in which the Si and Mn contents are controlled so as to satisfy a Si/Mn ratio of 0.4 or less, there are 10 or more fine Mn—Si composite oxide particles containing 0.5% by mass or more (Mn—Si) on a surface layer (an area 2 μm in depth and 10 μm in length), and an oxide mainly composed of Si accounts for 10% or less of the surface length of the steel sheet.

PTL 5 describes a multiphase high-strength cold-rolled steel sheet having excellent coating adhesion in which the Si and Mn contents are controlled so as to satisfy a Si/Mn ratio of 0.4 or less, there are 10/100 $\mu m^2$ or more fine Mn—Si composite oxide having a Mn/Si ratio of 0.5 or more, the fraction of surface coverage of an oxide mainly composed of Si is 10% or less, and there is no crack having a size in a predetermined range.

PTL 6 describes a multiphase high-strength cold-rolled steel sheet having excellent strength-elongation balance, that is, a high elongation/strength ratio, wherein the Si and Mn contents are controlled so as to satisfy a Si/Mn ratio of 0.4 or less, there are 10/100 pre or more fine Mn—Si composite oxide having a Mn/Si ratio of 0.5 or more, the fraction of surface coverage of an oxide mainly composed of Si is 10% or less, and the tensile strength is 390 MPa or more.

PTL 7 describes a high-strength steel sheet having excellent coating adhesion in which the average distance between the starting points of Si- and/or Mn-containing oxide stemming from a surface of the steel sheet in the depth direction in a network-like or hair-root-like manner is 5 μm or more, and the total length of the oxide is 10 μm/(12 μm in depth×20 μm in width) or less.

PTL 8 describes a Si—Mn oxide multiphase high-strength steel sheet having excellent coating adhesion in which the Si and Mn contents are controlled so as to satisfy a Si/Mn ratio of 0.4 or less, there are 10/100 $\mu m^2$ or more fine Si—Mn oxide on the surface, and the fraction of surface coverage of an oxide mainly composed of Si is 10% or less.

Although a Si—Mn composite oxide adversely affects chemical conversion treatability as with an oxide mainly composed of Si, the Si—Mn composite oxide easily dissolves in an acid. In the techniques described in PTLs 4 to 8, therefore, a Si—Mn composite oxide is intended to be removed by "in-line pickling", which is often provided in the production lines of cold-rolled steel sheets.

However, in the techniques described in PTLs 4 to 8, since the Mn content depends on the Si content, there is a problem of a limited degree of freedom in the design of steel components. There is also a problem that improvement in chemical conversion treatability is often limited.

It is known that zinc phosphate treatment for use in mechanical lubrication, which can be used in combination with a lubricant to facilitate plastic working, can be subjected to shot blasting as pretreatment to improve chemical conversion treatability. For example, PTL 9 describes a method for forming a conversion coating on a surface. The method includes ejecting a zinc phosphate chemical conversion treatment liquid to which silica sand has been added against the surface to clean the surface and then ejecting the zinc phosphate chemical conversion treatment liquid. It is assumed that the mechanism by which shot blasting before chemical conversion treatment can improve chemical conversion treatability is due to the mechanochemical activation of a surface by shot blasting (see NPL 1). However, leaving a shot-blasted surface to stand in the air or annealing a shot-blasted surface reduces the mechanochemical activity of the surface, failing to achieve a desired improvement in chemical conversion treatability.

Even when shot blasting is employed as pretreatment of coating, in consideration of actual physical distribution, a considerable amount of time elapses from the shot blasting to coating in the manufacture of steel sheets and steel tubes. In practical terms, therefore, the effects of improving chemical conversion treatability are markedly reduced and are not thought to be significant. The employment of continuous in-line shot blasting to reduce the time elapsed from shot blasting to coating requires considerable costs and therefore has a low degree of realizability.

PTL 10 describes a high-tensile hot-rolled steel sheet having excellent chemical conversion treatability and corrosion resistance, wherein the steel sheet contains 0.5% to 2.5% by mass Si and contains C and Ti such that C and Ti satisfy a particular relationship, the average grain diameter is 3.0 μm or less, and the surface roughness is controlled to 1.5 μm or less as an arithmetical mean roughness Ra. In accordance with the technique described in PTL 10, the small crystal grain diameter and the smooth surface result in a marked improvement in chemical conversion treatability.

NPL 2 has reported that the surface roughness of a steel sheet does not significantly affect chemical conversion treatability at Ra in the range of 0.5 to 1.7 μm, PPI in the range of 110 to 250, or Wz in the range of 1 to 8 μm.

PTL 11 describes a method for manufacturing cold-rolled steel sheets that can effectively improve phosphate treatability without impairing the press formability of the steel sheets. The method includes annealing of a steel sheet containing 0.01% by mass or less C, 0.01% by mass or less N, and Ti and skin pass rolling at a rolling reduction of 0.8% or more and 5% or less. In accordance with PTL 11, the chemical conversion treatability is saturated at a rolling reduction of 2.7% or more in the skin pass rolling.

CITATION LIST

Patent Literature

PTL 1: Japanese Unexamined Patent Application Publication No. 2003-226920

PTL 2: Japanese Unexamined Patent Application Publication No. 2004-256896

PTL 3: Japanese Unexamined Patent Application Publication No. 2004-323969

PTL 4: Japanese Unexamined Patent Application Publication No. 2005-248281

PTL 5: Japanese Unexamined Patent Application Publication No. 2005-281787

PTL 6: Japanese Unexamined Patent Application Publication No. 2005-290440

PTL 7: Japanese Unexamined Patent Application Publication No. 2006-144106

PTL 8: Japanese Unexamined Patent Application Publication No. 2005-187863

PTL 9: Japanese Examined Patent Application Publication No. 46-6327

PTL 10: Japanese Unexamined Patent Application Publication No. 2002-226944

PTL 11: Japanese Unexamined Patent Application Publication No. 62-116723

PTL 12: Japanese Unexamined Patent Application Publication No. 2004-292926

Non-Patent Literature

NPL 1: Tamai and Mori, Kinzoku Hyomen Gijutsu (The Journal of the Metal Finishing Society of Japan), vol. 31, (1980), pp. 482-486.

NPL 2: Suda et al., Tetsu To Hagane (Bulletin of the Iron and Steel Institute of Japan), vol. 66, (1980), pp. S1130.

SUMMARY OF THE INVENTION

Marketing steel sheets and other products are subjected to stamping or bending to manufacture members. Thus, the surface qualities of press dies may be transferred onto the surfaces of the steel sheets and other products. Furthermore, the steel sheets and other products may be deformed. The original surface qualities are therefore rarely maintained. Thus, it is difficult to think that steel sheets manufactured by the techniques described in PTLs 10 and 11 always have excellent chemical conversion treatability even after processing.

Since skin pass rolling results in hardening, the skin pass rolling of higher-strength materials will gradually become more difficult. The skin pass rolling of steel materials having a tensile strength on the order of 780 MPa or more is difficult to perform at a rolling reduction of 1% or more. The skin pass rolling of steel materials having a tensile strength on the order of 590 MPa may be performed at a rolling reduction of no more than approximately 2%. Thus, the technique described in PTL 11 in which skin pass rolling is performed at a rolling reduction of 0.8% or more and 5% or less cannot be applied to high-strength materials without causing problems.

Thus, the truth of the matter is that the related art described above cannot significantly improve the chemical conversion treatability of steel materials having a high Si content of more than 0.7% by mass.

In view of the situations of related art described above, it is advantageous to provide a high-strength steel tube that contains more than 0.7% by mass Si and has excellent formability and excellent chemical conversion treatability and a method for manufacturing the high-strength steel tube. More particularly, the present invention relates to a steel tube made of a steel sheet that contains more than 0.7% by mass Si in which an oxide mainly composed of Si is concentrated on a surface layer as in hot-rolled sheets or annealed sheets, and aims to improve the chemical conversion treatability of the steel tube without performing mechanical grinding or chemical pickling treatment as described in the techniques according to PTLs 1, 3, and 12.

The concentration of an oxide mainly composed of Si, as used herein, refers to the concentration of an oxide mainly composed of Si or an oxide containing Si and another element or the concentration of a composite oxide, a eutectic oxide, a peritectic oxide, or the like containing these. The term "steel tube", as used herein, refers to a steel tube manufactured by processing a steel sheet into a pipe shape by roll forming. The term "processing", as used herein, includes process steps, such as roll forming, jointing, and straightening. The roll forming includes continuous roll forming of a strip and roll forming of a cutlength sheet by U-bending or O-bending, as in the manufacture of electric-resistance-welded steel tubes. It goes without saying that the present invention is not limited to these and includes other tube-manufacturing methods. It also goes without saying that welding, such as electric-resistance welding, laser welding, or arc welding, or a joining method other than welding can be suitably used in jointing after roll forming.

To these ends, the present inventors have performed diligent research on various factors affecting the chemical conversion treatability of high-strength steel tubes having a high Si content. As a result, the present inventors have conceived the utilization of processing strain or the like applied to a surface during processing into a pipe shape. The present inventors found that the chemical conversion treatability of a high-strength steel tube having a high Si content can also be significantly improved by controlling the conditions for each process step of the processing such that the processing strain or the like applied to a surface during processing is a predetermined value or more.

The following describes the fundamental experimental results obtained by the present inventors.

Steel sheets having the compositions shown in Table 1 and the tensile properties shown in Table 2 were prepared. These steel sheets are pickling-treated hot-rolled steel sheets (hot-rolled pickled sheets) or continuously annealed (CAL) cold-rolled steel sheets (cold-rolled and annealed sheets). Test sheets were sampled from some steel sheets and were subjected to cold rolling under the conditions shown in Table 2 to form cold-rolled sheets. The chemical conversion treatability of these steel sheets was examined. The chemical conversion treatability was evaluated as described below.

A test specimen 1 having a size of 70 mm in the width direction and 150 mm in the rolling direction was sampled from a steel sheet. The test specimen 1 was successively subjected to degreasing treatment, water washing, surface conditioning, chemical conversion treatment, and cathodic electrodeposition coating. A test specimen 1 subjected to chemical conversion treatment but not subjected to cathodic electrodeposition coating was also prepared.

In the degreasing treatment, a surface of the test specimen 1 was sprayed with a drug solution SD250HM made by Nippon Paint Co., Ltd. at a temperature of 42° C. for 120 s. In the surface conditioning, the test specimen 1 was immersed in a chemical solution 5N-10 made by Nippon Paint Co., Ltd. for 30 s in a room temperature environment. In the chemical conversion treatment, the test specimen 1 was immersed in a chemical solution SD2800 made by Nippon Paint Co., Ltd. for 120 s at a liquid temperature of 43±3° C., a total phosphoric acid concentration (TA) in the range of 20 to 26 pt., a free acid concentration (FA) in the range of 0.7 to 0.9 pt., and an accelerator concentration (AC) in the range of 2.8 to 3.5 pt. and was baked at 170° C. for 20 min. For the evaluation of corrosion resistance after coating, the cathodic electrodeposition coating after the chemical conversion treatment involved the formation of a coating film having a thickness in the range of approximately 20 to 25 μm using a chemical solution PN-150 gray made by Nippon Paint Co., Ltd. at a liquid temperature of 28° C., an applied voltage of 180 V, and a treating time of 180 s.

As illustrated in FIG. 5(*a*), a crosscut 2 was formed on a surface of the test specimen 1 subjected to the cathodic electrodeposition coating. The ends of the test specimen 1 approximately 5 to 10 mm in width were covered with a masking tape 3. The test specimen 1 was then subjected to a salt dip test (SDT) involving immersion in a 5% NaCl aqueous solution (at a liquid temperature of 55° C.) for 10 days. After immersion, a cellophane tape was attached to the test specimen 1 and was then peeled off. As illustrated in FIG. 5(*b*), the maximum swollen width (one-side) 4 from the crosscut 2 was measured. The chemical conversion treatability was determined to be good when the maximum swollen width (one-side) 4 was 2.5 mm or less.

Furthermore, iron-zinc phosphate crystals of the test specimen 1 subjected to chemical conversion treatment were observed with a scanning electron microscope (magnification ratio: 1000). The chemical conversion treatability was determined to be good when the iron-zinc phosphate crystals were dense and "uniform grains" with "no crystal-free area".

The term "uniform grains", as used herein, refers to an average grain diameter ±20% or less for seemingly uniform grains and, for apparently a mixture of coarse grains and fine grains, means that the size of the coarse grains is not more than three times the size of the fine grains.

The term "no crystal-free area", as used herein, means that no "crystal-free area" can be observed at a magnification ratio of 1000 in two or more visual fields in random portions except abnormal portions. The term "crystal-free area" generally refers to an area having no iron-zinc phosphate crystal. However, observation under magnification shows that there are a portion seemingly free of iron-zinc phosphate crystals and a portion containing a small number of much smaller iron-zinc phosphate crystals than neighboring iron-zinc phosphate crystals at a very low density. Thus, the term "crystal-free area", as used herein, means that no iron-zinc phosphate crystal is formed in an area of more than three times the iron-zinc phosphate crystal grain size (diameter) for uniform iron-zinc phosphate crystal grains (an average grain diameter ±20% or less) and, for iron-zinc phosphate crystals containing a mixture of coarse grains and fine grains, means that no iron-zinc phosphate crystal is formed in an area of more than five times the size (diameter) of the coarse grains.

Table 2 shows the results.

A comparison of steel sheets Nos. 1 to 17 shows that the chemical conversion treatability is good (OK) at a Si content of 0.50% or less, but at a higher Si content, that is, more than 0.7%, the iron-zinc phosphate crystals deviate from uniform grains, there are many crystal-free areas, and the maximum swollen width (one-side) increases, indicating that the chemical conversion treatability tends to be poor (NG). On further examination, a comparison of the steel sheet No. 7 (a hot-rolled sheet) and the steel sheet No. 10 (a cold-rolled sheet) shows that the chemical conversion treatability tends to be somewhat good. This is probably because pickling removed an oxide mainly composed of Si concentrated in the surface layer and adversely affecting chemical conversion treatability. The steel sheet No. 14 having a low Si content has chemical conversion treatability similar to that of the steel sheet No. 13, which is a continuously annealed (CAL) sheet of the same type. With no or slight Si enrichment, it is presumed that the presence or absence of pickling treatment has a little influence on chemical conversion treatability.

Comparisons of the steel sheet No. 1 (steel No. A) and steel sheets No. 18 to No. 21 (steel No. A), the steel sheet No. 3 (steel No. C) and steel sheets No. 22 to No. 25 (steel No. C), and the steel sheet No. 4 (steel No. D) and steel sheets No. 26 to No. 29 (steel No. D) show that the cold rolling of a steel sheet having poor chemical conversion treatment at a rolling reduction of 5% or more markedly improves chemical conversion treatability. The steel sheet No. 1 is an example in which the dew point in a CAL furnace is higher than the dew point in cold-rolled steel sheets having a Si content of 1% or more and the surface enrichment of an oxide mainly composed of Si is considerable. Thus, the steel sheet No. 1 has the largest maximum swollen width (one-side) 4 (3.9 mm) from the crosscut 2 after the SDT test and belongs to the steel sheet group having the poorest chemical conversion treatability. The steel sheet No. 3 has a maximum swollen width (one-side) 4 (2.8 mm) slightly larger than 2.5 mm (the specification value of chemical conversion treatability) from the crosscut 2 after the SDT test and is a steel sheet having poor chemical conversion treatability. The steel sheet No. 4 has a maximum swollen width (one-side) 4 (2.2 mm) less than 2.5 mm (the specification value of chemical conversion treatability) from the crosscut 2 after the SDT test.

From these results, the present inventors found that with any steel sheet, even with a steel sheet in which an oxide mainly composed of Si is concentrated on a surface, the application of a surface strain of 5.0% or more on the surface, for example, by cold rolling can improve chemical conversion treatability. In particular, a surface strain of 7% or more resulted in a swollen width (one-side) of less than 2 mm, further improving chemical conversion treatability. Thus, the present inventors also found that the application of a surface strain of 7% or more is further effective.

The mechanism by which even the chemical conversion treatability of a steel sheet containing an oxide mainly composed of Si concentrated on a surface can be improved by applying a surface strain of 5.0% or more to the surface is not fully elucidated. The following is a possible mechanism.

It has often been pointed out that an oxide mainly composed of Si in a film form is concentrated on a surface of a steel sheet having a high Si composition. In the actual production using a continuous annealing line (CAL), an oxide mainly composed of Si is concentrated mostly in a granular form, for example, by in-line light pickling. In both cases, it is assumed that a granular oxide mainly composed of Si can be very easily removed (fell out) from the surface of the steel sheet by chemical conversion treatment under the surface strain of a predetermined value or more.

The present invention has been accomplished on the basis of these findings after further consideration. The exemplary aspects of the present invention are as follows:

(1) A high-strength steel tube having excellent chemical conversion treatability and excellent formability, manufactured by processing a mother steel sheet into a pipe shape by roll forming, the steel sheet having a composition containing, on the basis of mass percent, 0.05% or more C, more than 0.7% Si, and 0.8% or more Mn, preferably further containing 0.1% or less Al and 0.010% or less N, or further containing one or at least two selected from 0.03% or less Ti, 0.1% or less Nb, and 0.1% or less V, and/or one or at least two selected from 1% or less Cr, 1% or less Mo, 1% or less Ni, 1% or less Cu, and 0.01% or less B, and/or one or two selected from 0.1% or less Ca and 0.05% or less REM, and containing a remainder of Fe and incidental impurities, wherein the sum total of absolute circumferential surface strains each applied to a surface layer of the steel tube in individual process steps of the processing is 5% or more as nominal strain.

(2) The high-strength steel tube having excellent formability according to (1), wherein the sum total of absolute circumferential surface strains is the sum total of absolute circumferential surface strains and absolute longitudinal surface strains.

(3) The high-strength steel tube having excellent formability according to (1) or (2), wherein the sum total of absolute circumferential surface strains each applied in individual process steps of the processing is the sum total of the absolute value of the ratio of a thickness t to an outer diameter D of the steel tube, $t/D \times 100(\%)$, and the absolute value of reduction rate (or drawing rate) (%) in diameter-reduction-based straightening.

(4) The high-strength steel tube having excellent formability according to any one of (1) to (3), wherein the mother sheet is an annealed steel sheet.

(5) A high-strength steel tube having excellent chemical conversion treatability and excellent formability, manufactured by processing a mother steel sheet into a pipe shape by roll forming, the steel sheet having a composition containing, on the basis of mass percent, 0.05% or more C, more than 0.7% Si, and 0.8% or more Mn, preferably further containing 0.1% or less Al and 0.010% or less N, and optionally containing one or at least two selected from 0.03% or less Ti, 0.1% or less Nb, and 0.1% or less V, and/or one or at least two selected from 1% or less Cr, 1% or less Mo, 1% or less Ni, 1% or less Cu, and 0.01% or less B, and/or one or two selected from 0.1% or less Ca and 0.05% or less REM, and containing a remainder of Fe and incidental impurities, wherein the circumferential surface roughness Ra' of a surface layer of the steel tube and the surface roughness Ra of the steel sheet satisfy the following equation (1):

$$|Ra-Ra'|/Ra>0.05 \quad (1)$$

wherein Ra denotes the surface roughness of the steel sheet (mean value) (μm), and Ra' denotes the circumferential surface roughness of the outer surface layer and the inner surface layer of the welded steel tube (mean value) (μm).

(6) The high-strength steel tube having excellent formability according to any one of (1) to (5), wherein the composition contains, on the basis of mass percent, 0.05% or more C, 1% or more Si, and 1.5% or more Mn, preferably further contains 0.1% or less Al and 0.010% or less N, and optionally contains one or at least two selected from 0.03% or less Ti, 0.1% or less Nb, and 0.1% or less V, and/or one or at least two selected from 1% or less Cr, 1% or less Mo, 1% or less Ni, 1% or less Cu, and 0.01% or less B, and/or one or two selected from 0.1% or less Ca and 0.05% or less REM, and contains a remainder of Fe and incidental impurities.

(7) A method for manufacturing a high-strength steel tube having excellent chemical conversion treatability and excellent formability, including processing a mother steel sheet into a pipe shape by roll forming, the steel sheet having a composition containing, on the basis of mass percent, 0.05% or more C, more than 0.7% Si, and 0.8% or more Mn, preferably further containing 0.1% or less Al and 0.010% or less N, or further containing one or at least two selected from 0.03% or less Ti, 0.1% or less Nb, and 0.1% or less V, and/or one or at least two selected from 1% or less Cr, 1% or less Mo, 1% or less Ni, 1% or less Cu, and 0.01% or less B, and/or one or two selected from 0.1% or less Ca and 0.05% or less REM, and containing a remainder of Fe and incidental impurities, wherein each process step of the processing is controlled such that the sum total of absolute circumferential surface strains each applied to a surface layer of the steel tube in one of the process steps of the processing is 5% or more as nominal strain.

(8) The method for manufacturing a high-strength steel tube having excellent formability according to (7), wherein the sum total of absolute circumferential surface strains is the sum total of absolute circumferential surface strains and absolute longitudinal surface strains.

(9) The method for manufacturing a high-strength steel tube having excellent formability according to (7) or (8), wherein the process steps of the processing include a roll-forming process for altering a sheet shape or a strip shape into an open pipe shape by roll forming, a jointing process for joining both end faces of the open pipe shape, and a diameter-reduction-based straightening process for straightening the cross-sectional shape of a tube, and optionally a straightening process for straightening a bend of the tube.

(10) The method for manufacturing a high-strength steel tube having excellent formability according to (7), wherein the sum total of absolute circumferential surface strains each applied in individual process steps of the processing is the sum total of the absolute value of the ratio of a thickness t to an outer diameter D of the steel tube, t/D×100(%), and the absolute value of reduction rate (%) in diameter-reduction-based straightening.

(11) The method for manufacturing a high-strength steel tube having excellent formability according to (9), wherein the roll-forming process is a roll-forming process by a cage roll method.

(12) The method for manufacturing a high-strength steel tube having excellent formability according to any one of (7) to (11), wherein the mother sheet is an annealed steel sheet.

(13) The method for manufacturing a high-strength steel tube having excellent formability according to any one of (7) to (12), wherein the composition contains, on the basis of mass percent, 0.05% or more C, 1% or more Si, and 1.5% or more Mn, preferably further contains 0.1% or less Al and 0.010% or less N, or further contains one or at least two selected from 0.03% or less Ti, 0.1% or less Nb, and 0.1% or less V, and/or one or at least two selected from 1% or less Cr, 1% or less Mo, 1% or less Ni, 1% or less Cu, and 0.01% or less B, and/or one or two selected from 0.1% or less Ca and 0.05% or less REM, and contains a remainder of Fe and incidental impurities.

In accordance with embodiments of the present invention, a high-strength steel tube having a high Si content of more than 0.7% on the basis of mass percent can be a steel tube having excellent chemical conversion treatability without performing mechanical grinding or chemical pickling treatment. Thus, the present invention has significant industrial advantages. Also in accordance with embodiments of the present invention, a steel tube having excellent chemical conversion treatability can be manufactured independently of the history of a steel sheet used as a mother sheet and without the necessity for particular treatment in the manufacture of the mother sheet.

DESCRIPTION OF EMBODIMENTS

Figure 1:
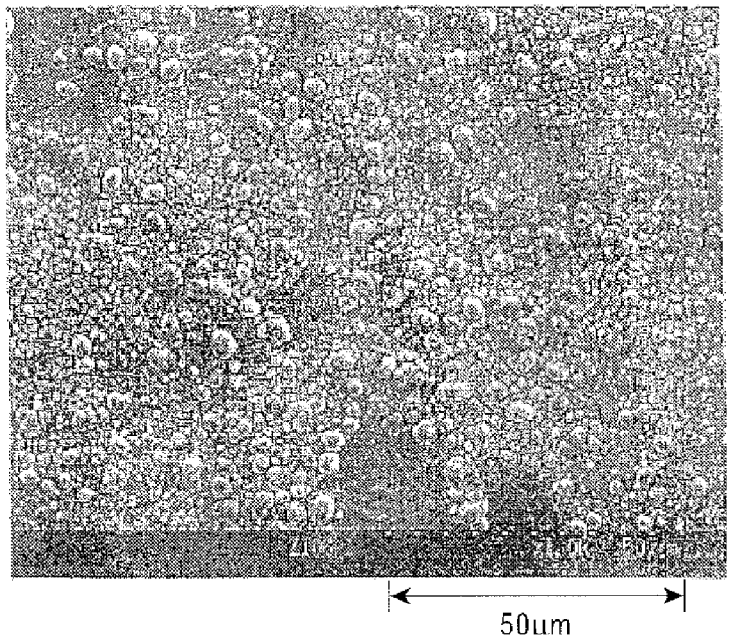
FIG. 1 is a scanning electron microscope photograph of a surface structure after the chemical conversion treatment of high Si steel.
Figure 2:
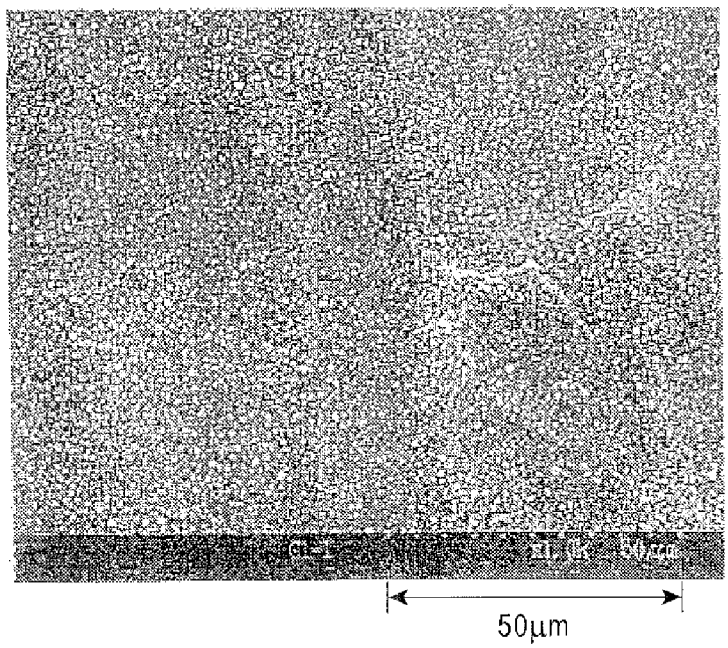
FIG. 2 is a scanning electron microscope photograph of a surface structure after the chemical conversion treatment of mild steel.

A steel tube according to embodiments of the present invention is a steel tube manufactured by processing a mother steel sheet having a high Si composition containing more than 0.7% by mass Si into a pipe shape by roll forming and is a high-strength steel tube having excellent chemical conversion treatability and excellent formability.

The term "processing", as used herein, includes a roll-forming process 9 for altering a sheet shape (a cutlength sheet shape) or a strip shape into an open pipe shape by batch-wise or continuous roll forming, a jointing process 10 for joining both end faces of the open pipe shape under pressure to form a tube, and a diameter-reduction-based straightening (sizing) process 11 for straightening the cross-sectional shape of the tube, and optionally a straightening process 13 for straightening a bend of the tube. In the jointing process 10, welding, such as electric-resistance welding, laser welding, or arc welding, or a joining method other than welding can be suitably used as the joining method.

The "high-strength" steel tube, as used herein, refers to a steel tube having a tensile strength of 590 MPa or more. A steel tube having "excellent formability", as used herein, refers to a steel tube having a total elongation value 1% or more higher than the total elongation value of steel tubes having the same strength level and a less Si content. More specifically, a steel tube having "excellent formability" refers to a steel tube containing more than 0.7% Si and having a tensile strength of 590 MPa or more and a total elongation El of approximately 10% or more.

The term "excellent chemical conversion treatability", as used herein, means that the structure of iron-zinc phosphate crystals and corrosion resistance after coating are both good. More specifically, iron-zinc phosphate crystals are dense and uniform grains and have a structure containing no crystal-free area, and a coating film after coating exposed to a corrosive environment has excellent corrosion resistance such that a phenomenon called an alkali blister or a puff at cathode area occurs insignificantly. The phenomenon called an alkali blister or a puff at cathode area is a phenomenon on the precondition of a wet coating film environment in which a crosscut area 2 acts as an anode, a portion that finally becomes a puff acts as a cathode, and the anode and the cathode constitute a cell including a coating film. Thus, the case where a puff of a coating film from the crosscut 2 is small is referred to as excellent corrosion resistance.

The term "uniform grains" in the context of the iron-zinc phosphate crystal structure refers to an average grain diameter ±20% or less for seemingly uniform grains and, for apparently a mixture of coarse grains and fine grains, means that the size of the coarse grains is not more than three times the size of the fine grains.

The term "no crystal-free area" in the context of the iron-zinc phosphate crystal structure means that no "crystal-free area" can be observed at a magnification ratio of 1000 in two or more visual fields in random portions near the center of a test sample except abnormal portions. The term "crystal-free area" generally refers to an area having no iron-zinc phosphate crystal. However, observation under magnification shows that there are a portion seemingly free of iron-zinc phosphate crystals and a portion containing a small number of much smaller iron-zinc phosphate crystals than neighboring iron-zinc phosphate crystals at a very low density. Thus, the term "crystal-free area", as used herein, means that no iron-zinc phosphate crystal is formed in an area of more than three times the iron-zinc phosphate crystal grain size (diameter) for uniform iron-zinc phosphate crystal grains (an average grain diameter ±20% or less) and, for iron-zinc phosphate crystals containing a mixture of coarse grains and fine grains, means that no iron-zinc phosphate crystal is formed in an area of more than five times the size (diameter) of the coarse grains.

The corrosion resistance after coating is examined and evaluated as described below.

Figure 5:
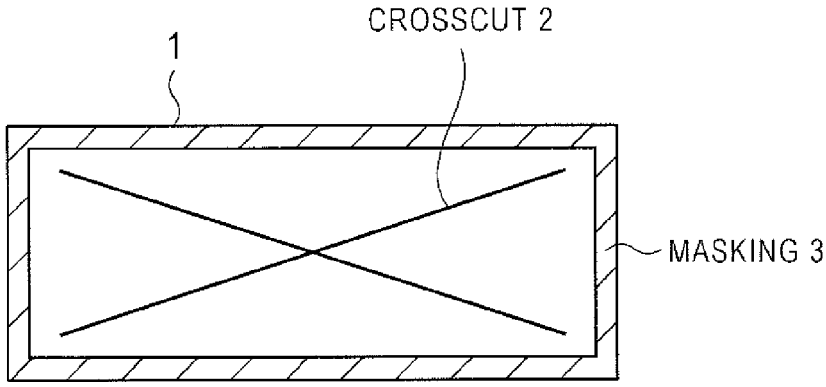
FIG. 5 is a schematic explanatory drawing illustrating an SDT test method by which the corrosion resistance of a coating film after coating is tested.
Figure 5:
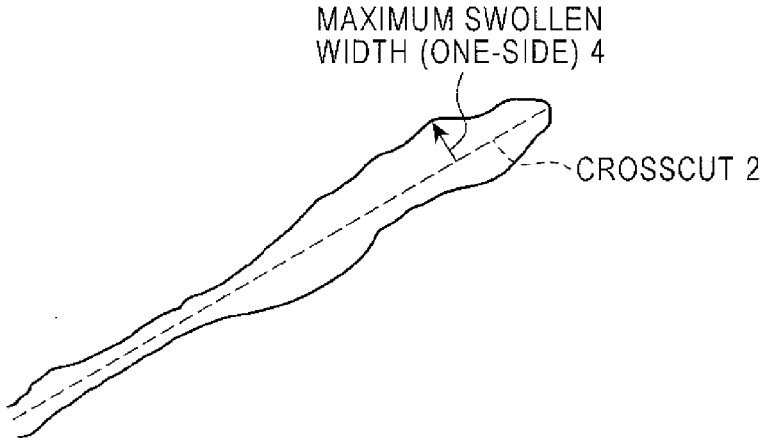

As illustrated in FIG. 5(*a*), a test specimen 1 includes a target area for a corrosion test surrounded by a masking tape 3. The target area (exposed portion) is at least 30 mm×100 mm. In the case of a steel tube, the test specimen 1 is a halved tube. If a steel tube for the test specimen 1 is too small to satisfy the exposed area described above, two or more test specimens 1 may be used for the evaluation.

The test specimen 1 is subjected to chemical conversion treatment and is coated with a film by electrodeposition coating. A crosscut 2 is then formed on a surface of the test specimen 1. After the corrosion test is performed, a maximum swollen width 4 on one side of the crosscut 2 is measured. The maximum swollen width 4 smaller than a predetermined value indicates excellent corrosion resistance after coating. The excellent chemical conversion treatability of the test specimen 1 may also be determined by simultaneously subjecting mild steel (SPCC) to the corrosion test and confirming that the corrosion resistance of the test specimen 1 is equivalent to or better than the corrosion resistance of the mild steel with the limits of error taken into account and that a normal portion other than the crosscut 2 and a portion adjacent to the crosscut 2 has no pimple, blister, swelling, or exposure of the substrate. The corrosion conditions for the corrosion test may be any corrosion test, such as a hot salt dip test, a salt spray test (SST), or a cyclic corrosion test.

First, the following describes the reason for limiting the composition of a steel sheet serving as a mother sheet for a steel tube according to embodiments of the present invention. Unless otherwise specified, the percent by mass is denoted simply by %.

C: 0.05% or more

C is an element that can increase the strength of steel. The C content of 0.05% or more is required to ensure a high tensile strength of 590 MPa or more. More than 0.5% C results in a deterioration in the integrity of an electric resistance weld. Thus, the C content is limited to 0.05% or more and preferably 0.5% or less, more preferably 0.3% or less. C has a very small influence on chemical conversion treatability.

Si: more than 0.7%

Si is an element that can contribute to the stabilization of ferrite, increase the strength of steel through solid-solution hardening or improvement in quenching hardenability, and improve formability. A large amount of Si generally results in a high elongation and improved formability but a marked deterioration in chemical conversion treatability. The deterioration of chemical conversion treatability is tolerable at a Si content of 0.7% or less. Thus, in embodiments of the present invention, the lowest Si content is more than 0.7% at which chemical conversion treatability is previously said to deteriorate markedly. The lowest Si content is preferably 1% or more. The Si content of 1% or more still has a problem in the chemical conversion treatability of steel sheets in the prior arts. Even at such a Si content that may previously result in a marked deterioration in chemical conversion treatability, however, the present invention can provide a steel tube having excellent chemical conversion treatability. Although the highest Si content in the present invention is not particularly limited, the Si content is preferably 2.5% or less in terms of the quality of a material.

The adverse effects of Si on chemical conversion treatability result from the surface enrichment of an oxide mainly composed of Si and do not result from the surface enrichment of Si alone. The surface enrichment of an oxide mainly composed of Si can occur during hot rolling. In this case, subsequent pickling treatment can partly remove the oxide. Annealing also causes surface enrichment in an annealing furnace. It is difficult to control the degree of enrichment of an oxide mainly composed of Si in the manufacture of steel sheets.

Mn: 0.8% or more

In the same manner as in C, Mn is an element that can increase the strength of steel through solid-solution hardening and improvement in quenching hardenability. In embodiments of the present invention, the Mn content of 0.8% or more is required to ensure a desired high strength. Furthermore, Mn can fix S in steel as MnS, thereby making S harmless. Thus, the Mn content is limited to 0.8% or more. The Mn content is preferably 1.5% or more to ensure the tensile strength of 780 MPa or more. An excessive amount of Mn of more than 5% results in a marked decrease in ductility. Thus, the Mn content is preferably limited to 5% or less.

In addition to the basic components described above, a composition further containing 0.1% or less Al and 0.010% or less N is preferred.

Al: 0.1% or less

Al is an element that can act as a deoxidizer and fix N as AlN, thereby preventing adverse effects of N. Such effects are significant at an Al content of 0.01% or more. The Al content of more than 0.1% results in an increase in the amount of Al-based inclusion, thereby impairing the cleanliness of steel. Thus, the Al content is limited to 0.1% or less, more preferably 0.06% or less.

N: 0.010% or less

In the same manner as in C, N is an element that can increase the strength of steel by solid solution. A large amount of N, however, results in a decrease in ductility and causes age hardening. Thus, the N content is preferably limited to 0.010% or less, more preferably 0.0050% or less.

In addition to the components described above, one or at least two selected from 0.03% or less Ti, 0.1% or less Nb, and 0.1% or less V, and/or one or at least two selected from 1% or less Cr, 1% or less Mo, 1% or less Ni, 1% or less Cu, and 0.01% or less B, and/or one or two selected from 0.1% or less Ca and 0.05% or less REM may be contained if necessary.

One or at least two selected from 0.03% or less Ti, 0.1% or less Nb, and 0.1% or less V Ti, Nb, and V are elements that can form carbonitrides, prevent the coarsening of crystal grains, and contribute to high strength through precipitation hardening. One or at least two of them may be appropriately used. Such effects can be observed at a Ti content of 0.01% or more, a Nb content of 0.005% or more, or a V content of 0.01% or more. However, a Ti content of more than 0.03%, a Nb content of more than 0.1%, or a V content of more than 0.1% results in a marked decrease in ductility. Thus, if present, the Ti content is preferably 0.03% or less, the Nb content is preferably 0.1% or less, and the V content is preferably 0.1% or less. More preferably, the Ti content is 0.025% or less, the Nb content is 0.05% or less, and the V content is 0.05% or less.

One or at least two selected from 1% or less Cr, 1% or less Mo, 1% or less Ni, 1% or less Cu, and 0.01% or less B Cr, Mo, Ni, Cu, and B are elements that can contribute to an increase in the strength of steel through solid-solution hardening or improvement in quenching hardenability. One or at least two of them can be appropriately used. Such effects can be observed at a Cr content of 0.03% or more, a Mo content of 0.02% or more, a Ni content of 0.03% or more, a Cu content of 0.02% or more, or a B content of 0.001% or more. Cu can contribute to improvements in corrosion resistance and resistance to delayed fracture. However, a Cr content of more than 1%, a Mo content of more than 1%, a Ni content of more than 1%, a Cu content of more than 1%, or a B content of more than 0.01% adversely affects weldability and the integrity of an electric resistance weld. Thus, if present, the Cr content is preferably 1% or less, the Mo content is preferably 1% or less, the Ni content is preferably 1% or less, the Cu content is preferably 1% or less, and the B content is preferably 0.01% or less. More preferably, the Cr, Mo, Ni, or Cu content is 0.5% or less, and the B content is 0.005% or less.

One or two selected from 0.1% or less Ca and 0.05% or less REM

Ca and REM are elements that can control the morphology of an inclusion and contribute to an improvement in ductility. One or two of them may be appropriately used. Such effects are significant at a Ca content of 0.002% or more or a REM content of 0.02% or more. However, a Ca content of more than 0.1% or a REM content of more than 0.05% results in an excessive amount of inclusion, thus lowering ductility. Thus, if present, the Ca content is preferably 0.1% or less, and the REM content is preferably 0.05% or less. More preferably, the Ca content is 0.01% or less, and the REM content is 0.01% or less.

The remainder other than the components described above are Fe and incidental impurities. Allowable incidental impurities are 0.02% or less P and 0.005% or less S. A P content of more than 0.02% or a S content of more than 0.005% results in a marked deterioration in toughness and weldability.

A steel sheet serving as a mother sheet of a steel tube according to the present invention may have any structure. A steel sheet having any structure, such as a ferrite-based structure, a martensite-based structure formed by quenching treatment during an annealing process after cold rolling, or a structure containing retained austenite or bainite, may be used as a mother sheet of a steel tube according to embodiments of the present invention. A steel sheet serving as a mother sheet of a steel tube according to the present invention may be manufactured by any method. A steel sheet manufactured by any method, such as a hot-rolled steel sheet or a cold-rolled steel sheet, whether annealed or not, is applicable as a mother sheet of a steel tube according to embodiments of the present invention.

Cold-rolled steel sheets are manufactured by pickling of hot-rolled steel sheets, subsequent cold rolling, and optionally annealing, such as continuous annealing. During the annealing process, such as continuous annealing, an oxide mainly composed of Si is again formed on the surface in an environment within an annealing furnace. The formation of an oxide mainly composed of Si depends greatly on the environment within an annealing furnace, that is, the atmosphere within the furnace (such as the dew point), the line speed, the timing of line stop in upstream and downstream processes, and unusual situations, such as the opening of the furnace, and cannot be fully estimated from the process parameters. Even steel sheets having different degrees of Si enrichment are applicable as mother sheets in embodiments of the present invention.

A steel tube according to embodiments of the present invention is manufactured by processing a mother steel sheet having the composition described above into a pipe shape by roll forming. A processing strain is applied to a surface layer of the steel tube such that the sum total of absolute circumferential surface strains each applied to the surface layer of the steel tube in individual process steps of the processing is 5% or more as nominal strain.

As described above, the process steps of the processing include the roll-forming process 9 for processing a mother sheet in a sheet shape (a cutlength sheet shape) by batch-wise roll forming or a mother sheet in a strip shape by continuous roll forming into an open pipe shape, the jointing process 10 for joining both end faces of the open pipe shape under pressure by welding, such as electric-resistance welding, laser welding, or arc welding, or a joining method other than welding to form a tube, and the diameter-reduction-based straightening (sizing) process 11 for straightening the cross-sectional shape of the tube, for example, with a sizer, and optionally the straightening process 13 for straightening a bend of the tube in the longitudinal direction.

A processing strain is applied to the inner and outer surface layers of the steel tube mainly by the roll-forming process 9, the diameter-reduction-based straightening process 11, and optionally the straightening process 13.

In the present invention, a processing strain is applied in each process step such that the sum total of absolute circumferential surface strains each applied to the outer surface layer and the inner surface layer of the tube in individual process steps of the processing is 5% or more as nominal strain. When the sum total of absolute circumferential surface strains each applied to the outer surface layer and the inner surface layer of the tube in individual process steps of the processing is less than 5%, a marked improvement in chemical conversion treatability cannot be expected.

In the present invention, the calculation of a surface strain applied in each process step of the processing from the mother sheet to the pipe shape is based on its absolute value without considering the tensile and compressive directions. Thus, the present invention utilizes, as a measure, the circumferential surface strain applied in each process step of the processing, that is, the sum total of absolute circumferential surface strains.

Figure 3:
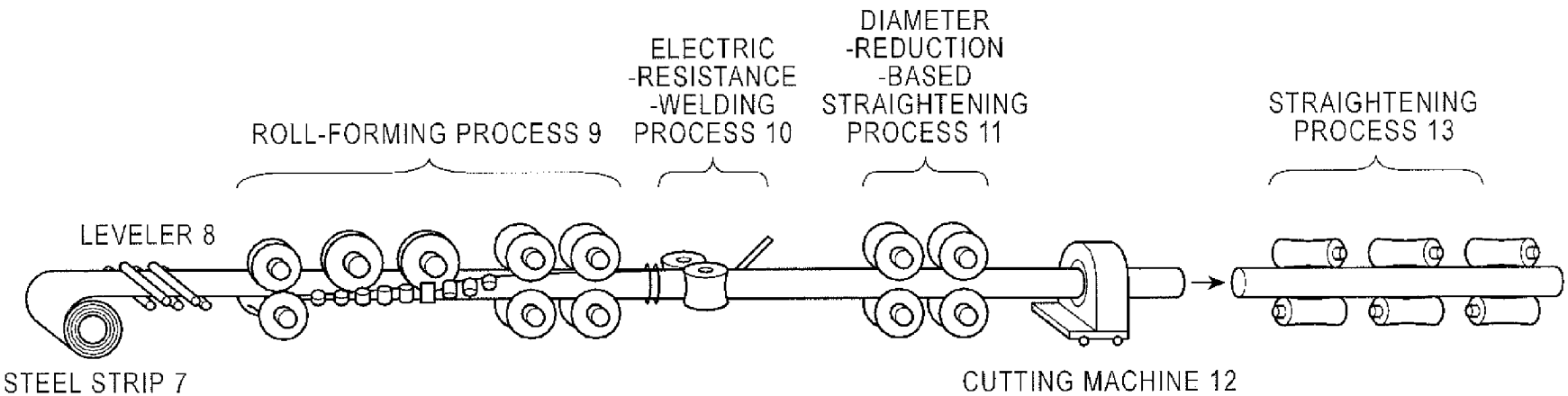
FIG. 3 is an explanatory drawing illustrating an example of manufacturing facilities suitable for the manufacture of a welded steel tube according to the present invention.

The surface strain applied in each process step of the processing from the mother sheet to the pipe shape will be described below with an electric-resistance-welded steel tube as an example. FIG. 3 illustrates an example of the manufacturing facilities of electric-resistance-welded tubes.

An electric-resistance-welded steel tube becomes a product tube through a process for manufacturing electric-resistance-welded tubes in which a steel sheet (a steel strip 8) is used as a mother sheet. The process for manufacturing electric-resistance-welded tubes includes the roll-forming process 9 as a process for processing the mother sheet into a pipe shape, the electric-resistance-welding process 10 as a jointing process, the diameter-reduction-based straightening process 11, for example, using a sizer, nondestructive inspection, for example, using ultrasonic waves, cutting into a predetermined length with a tube-cutting machine 12, and optionally the straightening process 13, for example, using a straightening machine.

Figure 4:
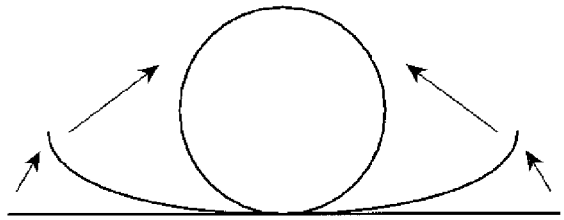
FIG. 4 is a schematic explanatory drawing illustrating alteration in cross-sectional shape in a roll-forming process.

In the roll-forming process 9, as illustrated in FIG. 4, as a result of a change from a sheet shape to a tube shape, a circumferential bending strain is applied to the outer surface layer and the inner surface layer of the tube. The bending strain geometrically depends on the thickness t and the outer diameter D of the resulting steel tube and is calculated by t/D×100(%) as described below. The bending strain becomes tensile strain on the outside and compressive strain on the inside of the tube. Assuming that a portion of the steel tube having an angle at the circumference of θ is bent, the bending strain of a surface layer of the steel tube can be calculated by the following equation.

$$(D/2\times\theta-(D-t)/2\times\theta)/((D-t)/2\times\theta)=t/(D-t)\cong t/D$$

The roll-forming process 9 may employ roll forming by a breakdown method or roll forming by a cage roll method. In order to improve chemical conversion treatability, the cage roll method, particularly a chance-free bulge roll forming (CBR) method, is preferred (for roll forming by the CBR method, see Kawasaki Steel Giho, vol. 32 (2000), pp. 49-53). This is probably because in roll forming by the cage roll method, particularly the CBR method, as compared with roll forming by the breakdown method, small forming rolls are densely arranged, and the rolls are directly and densely in contact with an outer surface of a forming material. However, effects of improving chemical conversion treatability depending on the type of roll forming method are not significantly larger than the improvement effects by the application of surface strain. This is because the improvement effects by the application of surface strain are significant even in the inside of a tube, and the contact with the rolls does not affect the improvement effects on chemical conversion treatability.

Figure 6:
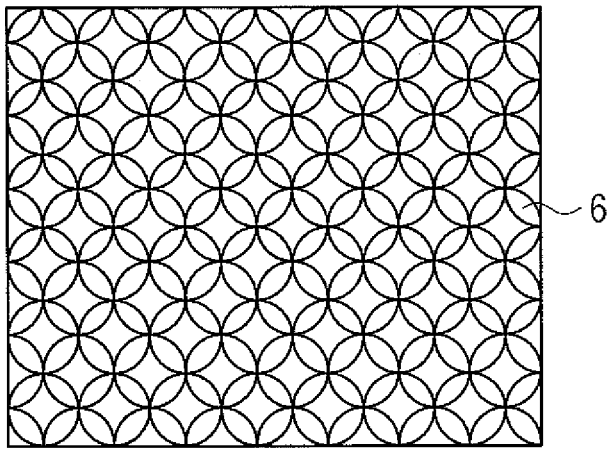
FIG. 6 is an explanatory drawing of an example of scribed circles 6.

Furthermore, in the electric-resistance-welding process 10, in addition to the geometrically determined strain (t/D×100(%)), the circumferential surface strain also includes a strain applied in accordance with the electric-resistance welding conditions (the initial steel strip width, the upset value, a decrease in steel strip width because of fusion, and the like) and a strain (tensile strain) resulting from the manufacture of the tube totally under a tension in the longitudinal direction. However, in view of predominant surface strain and ease with which the strain can be measured, the present invention employs the geometrically determined strain (t/D×100(%)) as the principal measure. Another strain can be measured by accurate measurement, for example, a scribed circles method 6 as illustrated in FIG. 6. In the present invention, depending on the situation, the geometrically determined strain t/D×100 (%) is used in combination with another strain. For example, the circumferential surface strain and the longitudinal surface strain can be calculated from circumferential and longitudinal changes in the dimensions of the scribed circles by the processing, that is, (diameter in the circumferential direction$_{after\ straightening}$−diameter in the circumferential direction$_{before\ straightening}$)/diameter in the circumferential direction$_{before\ straightening}$ and (diameter in the longitudinal direction$_{after\ straightening}$−diameter in the longitudinal direction$_{before\ straightening}$)/diameter in the longitudinal direction$_{before\ straightening}$.

In the diameter-reduction-based straightening process 11, sizing (the straightening of the cross-sectional shape of the tube) with a sizer produces circumferential and longitudinal surface strains on the outer surface layer and the inner surface layer due to the reduction rate (a change in the perimeter of the tube). The circumferential surface strain can be calculated from a change in the outer perimeter by sizing (straightening), that is, (outer perimeter$_{after\ straightening}$−outer perimeter$_{before\ straightening}$)/outer perimeter$_{before\ straightening}$. In the present invention, the circumferential surface strain applied in the diameter-reduction-based straightening process 11 is represented by (outer perimeter$_{after\ straightening}$−outer perimeter$_{before\ straightening}$)/outer perimeter$_{before\ straightening}$×100(%). Simultaneously, diameter-reduction-based straightening, for example, with a sizer also produces a strain on the inner surface layer. The strain applied to the inner surface layer is different from the strain applied to the outer surface layer in the strict sense. In the present invention, however, for convenience, the strain applied to the inner surface layer is considered to be the same as the strain applied to the outer surface layer.

In the straightening process 13, straightening with a straightening machine produces circumferential surface strains (and even longitudinal surface strains) on the outer surface layer and the inner surface layer of the tube in a manner that depends on the degree of bend of the tube. However, these strains vary with the conditions for manufacturing the tube and are difficult to accurately determine. Thus, in the present invention, these strains are not included in the circumferential surface strain on the surface of the steel tube.

In the present invention, the circumferential surface strain applied to a surface layer of a tube is not true strain but nominal strain. This is based on the finding that the chemical conversion treatability can be well explained by the sum total of absolute nominal strains applied in the process steps of the manufacture of an electric-resistance-welded tube.

A processing strain can also be applied to the outer surface layer and the inner surface layer of a tube in a different manner. For example, in addition to a tensile strain applied to a steel sheet with a leveler, the processing strain can be regulated by the control of the upset value in electric-resistance welding or the control of the line tension. Since the electric-resistance-welding process 10 is performed under a tension, an additional strain of approximately 1% can be applied to the outer surface layer and the inner surface layer of the tube as the processing strain.

Considering that a strain applied in the processing (the manufacture of an electric-resistance-welded tube), such as roll forming, is mainly a circumferential surface strain, the present invention focuses attention on the circumferential surface strain. As a matter of course, since the longitudinal surface strain also contributes to improvement in chemical conversion treatability, if a longitudinal surface strain is applied, the longitudinal surface strain is also taken into account, as well as the circumferential surface strain applied in each process step of the processing (the manufacture of an electric-resistance-welded tube). Even in that case, the calculation of strain is based on their absolute values irrespective of the tensile and compressive directions. More specifically, when a longitudinal surface strain is applied, the sum total of absolute circumferential surface strains may be the sum total of absolute circumferential surface strains and absolute longitudinal surface strains. In this case, the conditions for each process step of the processing (the manufacture of an electric-resistance-welded tube) is preferably controlled such that the sum total of absolute circumferential surface strains and absolute longitudinal surface strains is 5% or more.

However, the longitudinal surface strains depend on the line tension, the line speed, the reduction rate, and the outer diameter and the thickness of a tube in the manufacture of an electric-resistance-welded tube (processing) and cannot be easily measured. Thus, in the present invention, when the longitudinal surface strains must be measured, for example, scribed circles as illustrated in FIG. 6 are printed on a portion of a strip. After the manufacture of an electric-resistance-welded tube (processing), changes in the dimensions of the scribed circles are measured to determine the longitudinal surface strains. The scribed circles should be printed so as to be disposed on the outside of the tube after the manufacture of the electric-resistance-welded tube (processing). However, the longitudinal surface strains are not more than approximately 1%. Thus, the effects of the longitudinal surface strains may incidentally be recognized separately from the effects of the circumferential surface strains.

Although embodiments of the present invention are directed to steel tubes maintaining roundness, the present invention is also directed to steel tubes having low roundness and even closure-structure-based deformed pipes. These indefinite pipes are manufactured by processing a cutlength sheet, and chemical conversion treatment is often required only for a portion of the pipe. When chemical conversion treatment is required only for a portion of the pipe, it goes without saying that the portion is processed such that the sum total of absolute surface strains is 5% or more.

A steel tube according to embodiments of the present invention has the composition described above. The circumferential surface roughness Ra' of the outer surface layer and the inner surface layer of the tube and the surface roughness Ra of the steel sheet used satisfy the following equation (1):

$$|Ra-Ra'|/Ra>0.05 \quad (1)$$

wherein Ra denotes the surface roughness of the steel sheet (mean value) (μm), and Ra' denotes the circumferential surface roughness of the outer surface layer and the inner surface layer of the welded steel tube (mean value) (μm). When the circumferential Ra' of the outer surface layer and the inner surface layer of the tube and the surface roughness Ra of the steel sheet satisfy the equation (1), the tube is a steel tube having excellent chemical conversion treatability. Thus, the application of a surface strain in each process step of the processing (the manufacture of an electric-resistance-welded tube) to control the surface roughness so as to satisfy the equation (1) can significantly improve the chemical conversion treatability of the steel tube thus manufactured. The surface roughness is the arithmetical mean roughness Ra measured in accordance with the specifications of JIS B0601-2001. In the measurement of the surface roughness, it is important to determine the length and the region to be measured such that the surface roughness data are not influenced by the curvature. For example, for a small-diameter steel tube, measurement at the length and the region at which the influence of the curvature is small is preferably performed more than once to measure the surface roughness.

As described above, the application of a surface strain in each process step of the processing (the manufacture of an electric-resistance-welded tube) to control the surface roughness so as to satisfy the equation (1) can significantly improve the chemical conversion treatability of the steel tube thus manufactured. The mechanism for this is not fully elucidated but may be assumed as described below. The application of a predetermined surface strain produces microcracks on the surface, thereby increasing the surface roughness Ra. In immersion in a chemical conversion solution, an increase in surface roughness Ra results in an increase in the contact area of a base steel with the chemical conversion solution. This promotes the dissolution of the steel, thereby facilitating the removal of an oxide mainly composed of Si. It is also assumed that the application of a surface strain produces cracks at an interface between the base steel and an oxide mainly composed of Si in the surface layer, thereby facilitating the removal of the oxide mainly composed of Si. These may work synergistically to improve chemical conversion treatability.

A preferred method for manufacturing a steel tube will be described below.

In embodiments of the present invention, a steel sheet having the composition described above is used as a mother sheet, and the steel sheet is processed into a pipe shape through the process steps, forming a product tube (steel tube). The steel sheet used may be a hot-rolled steel sheet or a cold-rolled steel sheet provided that the steel sheet has the composition described above. Furthermore, annealing of the steel sheet does not cause any problem.

As described above, the process steps of the processing include the roll-forming process 9 for processing a mother sheet in a sheet shape (a cutlength sheet shape) by batch-wise roll forming or a mother sheet in a strip shape by continuous roll forming into an open pipe shape, the jointing process 10 for joining both end faces of the open pipe shape under pressure by welding, such as electric-resistance welding, laser welding, or arc welding, or a joining method other than welding to form a tube, and the diameter-reduction-based straightening (sizing) process 11 for straightening the cross-sectional shape of the tube, for example, with a sizer, and optionally the straightening process 13 for straightening a bend of the tube in the longitudinal direction.

In the roll-forming process 9, as illustrated in FIG. 4, as a result of a change from a sheet shape to a tube shape, a circumferential bending strain is applied to the outer surface layer and the inner surface layer of the tube. The circumferential surface strain applied in the roll-forming process 9 can be expressed by t/D×100(%), wherein t denotes the thickness of the steel tube, and D denotes the outer diameter of the steel tube. The directions of strain on the outer layer and the inner layer are opposite to each other.

In the diameter-reduction-based straightening process 11, the straightening of the cross-sectional shape of the tube produces circumferential and longitudinal surface strains on the outer surface layer and the inner surface layer due to a change in the perimeter of the tube. The circumferential surface strain applied to the outer layer in the diameter-reduction-based straightening process is compressive strain and is represented by the reduction rate (%), that is, (outer perimeter$_{after\ straightening}$−outer perimeter$_{before\ straightening}$)/outer perimeter$_{before\ straightening}$×100(%). Substantially the same strain in the same direction as the strain applied to the outer layer is applied to the inner layer.

In the straightening process 13, a bent of the tube in the longitudinal direction is straightened, for example, with a straightening machine. This straightening produces different circumferential surface strains depending on the degree of bend of the tube on the outer surface layer and the inner surface layer of the tube.

In embodiments of the present invention, the sum total of absolute circumferential surface strains applied to the outer surface layer and the inner surface layer of a tube in the process steps of the processing (the manufacture of an electric-resistance-welded tube) is adjusted to 5% or more as nominal strain. When the sum total of absolute circumferential surface strains applied in the process steps of the processing (the manufacture of an electric-resistance-welded tube) is less than 5%, a desired improvement in chemical conversion treatability cannot be achieved.

The sum total of absolute circumferential surface strains may be replaced with the sum total of absolute circumferential surface strains and absolute longitudinal surface strains. Since a tube is generally manufactured with a leveler and under a tension, a large surface strain is sometimes applied also in the longitudinal direction of the tube. In that case, the sum total of absolute circumferential surface strains may be combined with the absolute longitudinal surface strains. However, the longitudinal surface strains depend on the line tension, the line speed, the reduction rate, and the outer diameter and the thickness of a tube in the processing (the manufacture of an electric-resistance-welded tube) and cannot be easily measured. Thus, in the present invention, when the longitudinal surface strains must be measured, for example, scribed circles as illustrated in FIG. 6 are printed on a portion of a strip. After the processing (the manufacture of an electric-resistance-welded tube), changes in the dimensions of the scribed circles are measured to determine the longitudinal surface strains. The scribed circles should be printed such that the scribed circles are on the outside of the tube after the processing (the manufacture of the electric-resistance-welded tube). However, the longitudinal surface strains are not more than approximately 1%. Thus, the effects of the longitudinal surface strains may incidentally be recognized separately from the effects of the circumferential surface strains.

The present invention will be described in detail below with reference to examples.

EXAMPLES

Steel sheets No. 1 and No. 3 having the compositions shown in Table 1 and the tensile properties shown in Table 2 were prepared as mother sheets (steel strips). These steel strips were continuously annealed (CAL) cold-rolled steel strips (cold-rolled and annealed sheets). These steel strips (mother sheets) were formed into product tubes (welded steel tubes) having the dimensions shown in Table 3 through the process for manufacturing an electric-resistance-welded tube (the processing) shown in Table 3. The process for manufacturing an electric-resistance-welded tube (the processing) includes continuous steps of rewinding a coil of a steel strip, straightening the sheet with a leveler, forming a tube in a roll-forming process 9 and an electric-resistance-welding (jointing) process 10, and performing a diameter-reduction-based straightening process 11 with a sizer, and subsequently cutting into product tubes having predetermined dimensions with a cutting machine 12. Part of the product tubes were subsequently subjected to an off-line straightening process 13 with a straightening machine. During temporal line stops, sampling was performed in each of the process steps.

The roll-forming process 9 mainly employed a tube-manufacturing process by a CBR method. Some steel tubes were manufactured by a breakdown (BD) method. The BD method is a general tube-manufacturing process and employs large-diameter forming rolls arranged at moderate intervals. The tube-manufacturing process by this method unduly performs forming in each forming roll group with spring back taken into account and characteristically causes forming strain. In contrast, the tube-manufacturing process by the CBR method employs small-diameter forming rolls at short intervals and can form tubes having a small strain.

The circumferential surface strain applied in the roll-forming process 9 geometrically depends on the cross-sectional shape of a tube and was calculated by t/D×100(%). The circumferential surface strain applied in the diameter-reduction-based straightening process was calculated from the reduction rate (%) in the diameter-reduction-based straightening process 11, that is, (outer perimeter$_{after\ straightening}$−outer perimeter$_{before\ straightening}$)/outer perimeter$_{before\ straightening}$×100(%).

The longitudinal surface strains were measured in some steel tubes. After scribed circles (FIG. 6) having predetermined dimensions were transferred to a surface of a steel strip, the steel strip was formed into product tubes. The scribed circles on the product tubes were measured to determine the longitudinal surface strains.

Also in the straightening process 13, straightening produced circumferential surface strains. However, the circumferential surface strains were different from one tube to another and were difficult to measure. The circumferential surface strains were therefore not considered. If some surface strains were not measured, and the unmeasured surface strains may slightly increase the sum (total) of absolute surface strains applied, then the sum (total) was represented by "≅". If the unmeasured surface strains may increase the sum (total) of absolute surface strains by 0.5% or more, then the sum (total) was represented by ">".

The surface strains thus determined were also shown in Table 3.

The chemical conversion treatability of the welded steel tubes was evaluated.

A test specimen of a halved tube having a length in the range of 100 to 150 mm in the rolling direction was sampled from each of the steel tubes. The test specimen was then successively subjected to degreasing treatment, water washing, surface conditioning, chemical conversion treatment, and cathodic electrodeposition coating. A test specimen subjected to chemical conversion treatment but not subjected to cathodic electrodeposition coating was also prepared.

In the degreasing treatment, a surface of the test specimen was sprayed with a drug solution SD250HM made by Nippon Paint Co., Ltd. at a temperature of 42° C. for 120 s. In the surface conditioning, the test specimen was immersed in a chemical solution 5N-10 made by Nippon Paint Co., Ltd. for 30 s in a room temperature environment. In the chemical conversion treatment, the test specimen was immersed in a chemical solution SD2800 made by Nippon Paint Co., Ltd. for 120 s at a liquid temperature of 43±3° C., a total phosphoric acid concentration (TA) in the range of 20 to 26 pt., a free acid concentration (FA) in the range of 0.7 to 0.9 pt., and an accelerator concentration (AC) in the range of 2.8 to 3.5 pt. and was baked at 170° C. for 20 min. In the cathodic electrodeposition coating, a coating film having a thickness in the range of approximately 20 to 25 μm was formed using PN-150 gray at a liquid temperature of 28° C., an applied voltage of 180 V, and a treating time of 180 s.

As illustrated in FIG. 5(*a*), a crosscut 2 was formed on the outer surface and the inner surface of the test specimen 1 subjected to the cathodic electrodeposition coating. The ends of the test specimen 1 approximately 10 mm in width were covered with a masking tape 3. The test specimen 1 was then subjected to a SDT test involving immersion in a 5% NaCl aqueous solution (at a liquid temperature of 55° C.) for 10 days. After immersion, a cellophane tape was attached to the test specimen 1 and was then peeled off. As illustrated in FIG. 5(*b*), the maximum swollen width (one-side) 4 from the crosscut 2 was measured on the inner surface and the outer surface. The chemical conversion treatability was determined to be good (OK) when the maximum swollen width (one-side) 4 was 2.5 mm or less. Otherwise, the chemical conversion treatability was determined to be poor (NG).

Furthermore, iron-zinc phosphate crystals on the inner surface and the outer surface of the test specimen 5 subjected to chemical conversion treatment were observed with a scanning electron microscope (magnification ratio: 1000). The chemical conversion treatability was determined to be good (OK) when the iron-zinc phosphate crystals were dense "uniform grains" with "no crystal-free area". Otherwise, the chemical conversion treatability was determined to be poor (NG). The definitions of "uniform grains" and "no crystal-free area" were the same as in the basic experiment described above.

The surface roughness of the inner surface and the outer surface of some of the welded steel tubes was measured. The surface roughness was the arithmetical mean roughness Ra (mean value) measured in accordance with the specifications of JIS B0601-2001. The Ra (mean value) was measured with a contact-type roughness tester at circumferential positions at a length of 5 mm or more. Depending on the outer diameter, partitions convenient for the measurement of surface roughness were measured along the total length of 5 mm or more, and their arithmetic mean was calculated.

Table 4 shows the results.

Although the mother sheets (the steel sheets No. 1 and No. 3) have poor chemical conversion treatability, all the steel tubes according to the working examples have excellent chemical conversion treatability. An increase in circumferential surface strains (including the sum total of the circumferential surface strains and absolute longitudinal surface strains) applied results in a decrease in swollen width (one-side) and improvement in chemical conversion treatability. A test specimen of a steel tube No. 4 was sampled while the line was stopped in the diameter-reduction-based straightening process 11 after the electric-resistance-welding process 10 (working example). In the steel tube No. 4, the sum total of circumferential surface strains (nominal strains) applied in the process steps was 5% (4.6%). In combination with the effects of the longitudinal surface strains (unmeasured), the steel tube No. 4 has improved chemical conversion treatability. Examples (steel tubes No. 9 and No. 10) after the straightening process 13 with a straightening machine have a smaller swollen width (one-side) than examples without the straightening process 13 (steel tubes No. 5 and No. 6) and improved chemical conversion treatability. Even when the circumferential surface strains (nominal strains) are less than 5%, in some cases, the surface strains including the longitudinal surface strains are or are assumed to be more than 5%, and the chemical conversion treatability is improved (steel tubes No. 12, No. 13, No. 18, No. 19, and No. 21). Steel tubes No. 14 and No. 15 (working examples) formed by roll forming by the BD method have improved chemical conversion treatability but tend to have slightly poorer chemical conversion treatability than the steel tubes No. 5 and No. 6 (working examples) formed by roll forming by the CBR method.

In contrast, comparative examples outside the scope of the present invention have poor chemical conversion treatability.

A steel tube No. 1, which is a mother sheet and serves as a reference, has poor chemical conversion treatability. A steel tube No. 2, a test specimen of which was sampled while the line was stopped after passing through the leveler and before the roll-forming process 9, has a smaller swollen width (one side) than the mother sheet (the steel tube No. 1), but exhibits a small improvement in chemical conversion treatability. A test specimen of a steel tube No. 3 was sampled while the line was stopped after the roll-forming process 9 and before the electric-resistance welding 10. In the steel tube No. 3, the surface strains applied are less than a predetermined value. The steel tube No. 3 has an insufficient improvement in chemical conversion treatability. Test specimens of steel tubes No. 11 and No. 22 were sampled while the line was stopped after the electric-resistance-welding process 10 and before the diameter-reduction-based straightening process 11 (comparative examples). In the steel tubes No. 11 and No. 22, the surface strains applied are less than a predetermined value. The steel tubes No. 11 and No. 22 have an insufficient improvement in chemical conversion treatability.

The surface roughness Ra' of the inner surface and the outer surface of a steel tube and the surface roughness Ra of a mother sheet satisfying the equation (1) result in improved chemical conversion treatability. As in the steel tube No. 22, the surface roughness Ra' of at least one of the inner surface and the outer surface of a steel tube does not satisfy the equation (1), improvement in chemical conversion treatability is not observed.

In accordance with the present invention, a high-strength steel tube having a high Si content of more than 0.7% on the basis of mass percent can be a steel tube having excellent chemical conversion treatability without performing mechanical grinding or chemical pickling treatment. Thus, the present invention has significant industrial advantages.

| Reference Signs List | |
|---|---|
| 1: | test specimen (for crosscut) |
| 2: | crosscut |
| 3: | masking |
| 4: | maximum swollen width (one-side) |

-continued

| Reference Signs List | |
|---|---|
| 5: | test specimen (for the presence or absence of crystal-free area) |
| 6: | scribed circles |
| 7: | steel strip |
| 8: | leveler |
| 9: | roll-forming process |
| 10: | electric-resistance-welding process |
| 11: | diameter-reduction-based straightening process |
| 12: | cutting machine |
| 13: | straightening process |

TABLE 1

| Steel | Components (% by mass) | | | | | | | | | |
|---|---|---|---|---|---|---|---|---|---|---|
| No. | C | Si | Mn | P | S | Al | N | Nb, Ti, V | Mo, Cr, Ni, Cr, B | Ca, REM |
| A | 0.13 | 1.50 | 1.80 | 0.009 | 0.002 | 0.045 | 0.0025 | — | — | — |
| B | 0.14 | 1.30 | 1.50 | 0.009 | 0.002 | 0.045 | 0.0025 | — | — | — |
| C | 0.15 | 1.75 | 2.00 | 0.008 | 0.001 | 0.045 | 0.0030 | — | — | — |
| D | 0.12 | 1.45 | 2.00 | 0.008 | 0.001 | 0.055 | 0.0018 | — | — | — |
| E | 0.09 | 0.30 | 3.00 | 0.015 | 0.002 | 0.045 | 0.0018 | — | — | — |
| F | 0.004 | 0.55 | 2.50 | 0.025 | 0.010 | 0.050 | 0.0025 | Ti: 0.003 | — | — |
| G | 0.11 | 0.45 | 1.80 | 0.010 | 0.001 | 0.042 | 0.0035 | Ti: 0.002, Nb: 0.0009 | Cr: 0.03, Mo: 0.02, B: 0.0011, Cu: 0.02 | — |
| H | 0.055 | 1.00 | 2.40 | 0.012 | 0.002 | 0.035 | 0.0023 | — | — | — |
| I | 0.12 | 1.60 | 2.00 | 0.009 | 0.001 | 0.038 | 0.0025 | — | — | Ca: 0.002 |
| J | 0.10 | 0.45 | 1.90 | 0.010 | 0.001 | 0.030 | 0.0030 | Nb: 0.012 | B: 0.0015 | — |
| K | 0.13 | 0.50 | 1.50 | 0.010 | 0.002 | 0.045 | 0.0025 | Nb: 0.009 | B: 0.0012 | — |
| L | 0.22 | 0.30 | 1.80 | 0.012 | 0.001 | 0.045 | 0.0035 | Ti: 0.02, Nb: 0.008 | B: 0.0021 | — |
| M | 0.02 | 0.02 | 0.20 | 0.011 | 0.012 | 0.035 | 0.0025 | — | — | — |
| N | 0.04 | 0.02 | 0.22 | 0.015 | 0.011 | 0.035 | 0.0025 | — | — | — |
| O | 0.08 | 0.70 | 1.70 | 0.008 | 0.002 | 0.055 | 0.0030 | — | — | — |
| P | 0.09 | 0.72 | 1.50 | 0.008 | 0.002 | 0.055 | 0.0030 | — | — | — |
| Q | 0.07 | 0.85 | 2.20 | 0.008 | 0.002 | 0.055 | 0.0030 | — | — | — |

TABLE 2

| Steel | | Thick- | | Tensile properties | | | Chemical conversion treatability | |
|---|---|---|---|---|---|---|---|---|
| sheet No. | Steel No. | ness mm | Type | YS MPa | TS MPa | EI % | Oxide crystals* | Corrosion resistance of coating film** (Swollen width (one-side): mm) |
| 1 | A | 2.0 | Cold-rolled continuously annealed sheet | 695 | 990 | 18 | NG | NG(3.9) |
| 2 | B | 1.8 | Cold-rolled continuously annealed sheet | 760 | 1150 | 19 | OK | OK(1.8) |
| 3 | C | 1.8 | Cold-rolled continuously annealed sheet | 810 | 1230 | 15 | NG | NG(2.8) |
| 4 | D | 2.0 | Cold-rolled continuously annealed sheet | 710 | 1050 | 18 | OK | OK(2.2) |
| 5 | E | 1.4 | Cold-rolled continuously annealed sheet | 640 | 1040 | 14 | OK | OK(1.5) |
| 6 | F | 0.8 | Cold-rolled continuously annealed sheet | 320 | 460 | 39 | OK | OK(1.4) |
| 7 | G | 2.8 | Hot-rolled pickled sheet | 770 | 830 | 18 | OK | OK(1.1) |
| 8 | H | 0.7 | Cold-rolled continuously annealed sheet | 500 | 830 | 21 | OK | OK(2.4) |
| 9 | I | 0.7 | Cold-rolled continuously annealed sheet | 920 | 1250 | 13 | NG | NG(4.0) |
| 10 | J | 0.8 | Cold-rolled continuously annealed sheet | 980 | 1220 | 8 | OK | OK(1.6) |
| 11 | K | 0.7 | Cold-rolled continuously annealed sheet | 1150 | 1390 | 8 | OK | OK(1.7) |
| 12 | L | 0.7 | Cold-rolled continuously annealed sheet | 1180 | 1500 | 7 | OK | OK(0.9) |
| 13 | M | 0.8 | Cold-rolled continuously annealed sheet | 360 | 530 | 31 | OK | OK(0.5) |
| 14 | N | 2.8 | Hot-rolled pickled sheet | 250 | 360 | 42 | OK | OK(0.5) |
| 15 | O | 1.8 | Cold-rolled continuously annealed sheet | 420 | 810 | 21 | OK | OK(2.1) |
| 16 | P | 2.0 | Cold-rolled continuously annealed sheet | 435 | 830 | 19 | NG | NG(2.6) |
| 17 | Q | 1.4 | Cold-rolled continuously annealed sheet | 480 | 875 | 17 | OK | OK(2.4) |
| 18 | A | — | Cold-rolled sheet of steel sheet No. 1 (rolling reduction: 2.5%) | — | — | — | NG | NG(3.1) |
| 19 | A | — | Cold-rolled sheet of steel sheet No. 1 (rolling reduction: 5%) | — | — | — | OK | OK(2.5) |
| 20 | A | — | Cold-rolled sheet of steel sheet No. 1 (rolling reduction: 7.5%) | — | — | — | OK | OK(2.0) |
| 21 | A | — | Cold-rolled sheet of steel sheet No. 1 (rolling reduction: 10%) | — | — | — | OK | OK(1.9) |
| 22 | C | — | Cold-rolled sheet of steel sheet No. 3 (rolling reduction: 2.5%) | — | — | — | NG | NG(2.6) |
| 23 | C | — | Cold-rolled sheet of steel sheet No. 3 (rolling reduction: 5%) | — | — | — | OK | OK(2.3) |
| 24 | C | — | Cold-rolled sheet of steel sheet No. 3 (rolling reduction: 7.5%) | — | — | — | OK | OK(1.5) |
| 25 | C | — | Cold-rolled sheet of steel sheet No. 3 (rolling reduction: 10%) | — | — | — | OK | OK(1.3) |
| 26 | D | — | Cold-rolled sheet of steel sheet No. 4 (rolling reduction: 2.5%) | — | — | — | OK | OK(2.2) |
| 27 | D | — | Cold-rolled sheet of steel sheet No. 4 (rolling reduction: 5%) | — | — | — | OK | OK(1.7) |

TABLE 2-continued

| Steel sheet No. | Steel No. | Thickness mm | Type | Tensile properties YS MPa | TS MPa | EI % | Chemical conversion treatability Oxide crystals* | Corrosion resistance of coating film** (Swollen width (one-side): mm) |
|---|---|---|---|---|---|---|---|---|
| 28 | D | — | Cold-rolled sheet of steel sheet No. 4 (rolling reduction: 7.5%) | — | — | — | OK | OK(1.3) |
| 29 | D | — | Cold-rolled sheet of steel sheet No. 4 (rolling reduction: 10%) | — | — | — | OK | OK(1.1) |

*OK: Uniform grains with no crystal-free area. NG: Other than OK

**OK: Swollen width (one-side) is 2.5 mm or less. NG: Other than OK

TABLE 3

| | | Shape of tube | | Processing step | | | | Surface strain applied in circumferential direction (absolute value) | | | | | | |
|---|---|---|---|---|---|---|---|---|---|---|---|---|---|---|
| Steel tube No. | Steel sheet No. | Thick-ness T (mm) | Outer diameter D (mm) | Roll forming | Diameter-reduction-based straightening | Straightening | Note | Roll forming t/d × 100 (%) | Reduction rate in diameter-reduction-based straightening* (%) | Straightening | Sum (%) | Surface strain applied in longitudinal direction (absolute value) | Surface strain applied (total) % | Note |
| 1 | 1 | 2 | — | — | — | — | — | — | — | — | — | — | — | Reference |
| 2 | 1 | 2 | — | CBR method | — | — | Extracted after leveler | — | — | — | — | — | — | Comparative example |
| 3 | 1 | 2 | 48.6 | CBR method | — | — | Extracted before electric resistance welding | ≈4.1 | — | — | ≈4.1 | Not measured | ≈4.1 | Comparative example |
| 4 | 1 | 2 | 48.6 | CBR method | Yes | — | Extracted during diameter-reduction-based straightening | 4.1 | 0.5 | — | 4.6 | Not measured | >4.6 | Example |
| 5 | 1 | 2 | 48.6 | CBR method | Yes | — | | 4.1 | 1.0 | — | 5.1 | 1.2 | 6.3 | Example |
| 6 | 1 | 2 | 48.6 | CBR method | Yes | — | | 4.1 | 1.5 | — | 5.6 | 1.0 | 6.6 | Example |
| 7 | 1 | 2 | 48.6 | CBR method | Yes | — | | 4.1 | 2.0 | — | 6.1 | Not measured | >6.1 | Example |
| 8 | 1 | 2 | 48.6 | CBR method | Yes | — | | 4.1 | 2.5 | — | 6.6 | Not measured | >6.6 | Example |
| 9 | 1 | 2 | 48.6 | CBR method | Yes | Yes | | 4.1 | 1.0 | Yes | ≈5.1 | Not measured | >5.1 | Example |
| 10 | 1 | 2 | 48.6 | CBR method | Yes | Yes | | 4.1 | 1.5 | Yes | ≈6.6 | Not measured | >5.6 | Example |
| 11 | 1 | 2 | 70.0 | CBR method | — | — | Extracted during diameter-reduction-based straightening | 2.9 | Not measured | — | ≈2.9 | Not measured | >2.9 | Comparative example |
| 12 | 1 | 2 | 70.0 | CBR method | Yes | Yes | | 2.9 | 1.0 | Yes | ≈3.9 | 1.2 | ≈5.1 | Example |
| 13 | 1 | 2 | 70.0 | CBR method | Yes | Yes | | 2.9 | 1.5 | Yes | ≈4.4 | 0.8 | ≈5.2 | Example |
| 14 | 1 | 2 | 48.6 | CBR method | — | — | | 4.1 | 1.5 | — | 5.6 | Not measured | >5.6 | Example |
| 15 | 1 | 2 | 48.6 | CBR method | — | — | | 4.1 | 1.5 | — | 5.6 | Not measured | >5.6 | Example |
| 16 | 1 | 2 | 31.8 | CBR method | Yes | Yes | | 6.3 | 1.0 | Yes | ≈7.3 | Not measured | >7.3 | Example |
| 17 | 3 | 1.2 | — | CBR method | — | — | — | — | — | — | — | — | — | Reference |
| 18 | 3 | 1.2 | 70.0 | CBR method | Yes | Yes | | 1.7 | 1.5 | Yes | ≈3.2 | 1.9 | ≈5.1 | Example |
| 19 | 3 | 1.2 | 48.6 | CBR method | Yes | Yes | | 2.5 | 1.5 | Yes | ≈4.0 | Not measured | >4.0 | Example |
| 20 | 3 | 1.2 | 48.6 | CBR method | Yes | Yes | | 2.5 | 0.5 | Yes | ≈3.0 | 0.5 | ≈3.5 | Comparative example |
| 21 | 3 | 1.2 | 48.6 | CBR method | Yes | Yes | | 2.5 | 1.5 | Yes | ≈4.0 | 1.0 | ≈5.0 | Example |
| 22 | 3 | 1.2 | 31.8 | CBR method | — | — | Extracted during diameter-reduction-based straightening | 3.8 | Not measured | — | ≈3.8 | Not measured | ≈3.8 | Comparative example |
| 23 | 3 | 1.2 | 31.8 | CBR method | Yes | Yes | | 3.8 | 1.0 | Yes | ≈4.8 | Not measured | >4.8 | Example |
| 24 | 3 | 1.2 | 31.8 | CBR method | Yes | Yes | | 3.8 | 2.0 | Yes | ≈5.8 | Not measured | >5.8 | Example |
| 25 | 3 | 1.2 | 31.8 | CBR method | Yes | Yes | | 3.8 | 0.5 | Yes | ≈4.7 | 0.5 | ≈5.2 | Example |

*Drawing rate: $(\text{perimeter}_{after\ straightening} - \text{perimeter}_{before\ straightening})/\text{perimeter}_{before\ straightening} \times 100\ (\%)$

TABLE 4

| Steel tube No. | Steel sheet No. | Surface roughness Ra (micrometer) Ouside | Inside | Left-hand side value in equation (1)*** Outside | Inside | Conformity with equation (1) | Chemical conversion treatability: Oxide crystals* Outside | Inside | Corrosion resistance of coating film** (Swollen width (one-side): mm) Outside | Inside | Note |
|---|---|---|---|---|---|---|---|---|---|---|---|
| 1 | 1 | 0.68 | 0.68 | — | — | — | NG | | NG(3.9) | | Reference (mother sheet) |
| 2 | 1 | —**** | —**** | — | — | — | NG | | NG(3.7) | | Comparative example |
| 3 | 1 | —**** | —**** | — | — | — | NG | NG | NG(2.8) | NG(2.8) | Comparative example |
| 4 | 1 | —**** | —**** | — | — | — | OK | OK | OK(2.1) | OK(2.2) | Example |
| 5 | 1 | 0.52 | 0.79 | 0.24 | 0.16 | Good | OK | OK | OK(1.2) | OK(1.9) | Example |
| 6 | 1 | 0.5 | 0.81 | 0.26 | 0.19 | Good | OK | OK | OK(1.0) | OK(1.2) | Example |
| 7 | 1 | 0.48 | 0.83 | 0.29 | 0.22 | Good | OK | OK | OK(0.9) | OK(1.1) | Example |
| 8 | 1 | —**** | —**** | — | — | — | OK | OK | OK(0.7) | OK(0.9) | Example |
| 9 | 1 | —**** | —**** | — | — | — | OK | OK | OK(1.1) | OK(1.5) | Example |
| 10 | 1 | —**** | —**** | — | — | — | OK | OK | OK(1.1) | OK(1.1) | Example |
| 11 | 1 | —**** | —**** | — | — | — | NG | NG | NG(3.1) | NG(3.1) | Comparative example |
| 12 | 1 | —**** | —**** | — | — | — | OK | OK | OK(2.4) | OK(2.4) | Example |
| 13 | 1 | —**** | —**** | — | — | — | OK | OK | OK(2.2) | OK(2.3) | Example |
| 14 | 1 | —**** | —**** | — | — | — | OK | OK | OK(1.5) | OK(1.9) | Example |
| 15 | 1 | —**** | —**** | — | — | — | OK | OK | OK(1.3) | OK(1.6) | Example |
| 16 | 1 | —**** | —**** | — | — | — | OK | OK | OK(0.8) | OK(1.0) | Example |
| 17 | 3 | 0.58 | 0.58 | — | — | — | NG | | NG(2.8) | | Reference (mother sheet) |
| 18 | 3 | —**** | —**** | — | — | — | OK | OK | OK(2.3) | OK(2.5) | Example |
| 19 | 3 | —**** | —**** | — | — | — | OK | OK | OK(2.2) | OK(2.3) | Example |
| 20 | 3 | —**** | —**** | — | — | — | NG | NG | NG(2.6) | NG(2.7) | Comparative example |
| 21 | 3 | —**** | —**** | — | — | — | OK | OK | OK(2.2) | OK(2.2) | Example |
| 22 | 3 | 0.52 | 0.61 | 0.1 | 0.05 | Poor | OK | NG | OK(2.5) | NG(2.7) | Comparative example |
| 23 | 3 | —**** | —**** | — | — | — | OK | OK | OK(2.0) | OK(2.2) | Example |
| 24 | 3 | 0.41 | 0.64 | 0.29 | 0.1 | Good | OK | OK | OK(0.9) | OK(1.7) | Example |
| 25 | 3 | —**** | —**** | — | — | — | OK | OK | OK(1.8) | OK(2.2) | Example |

*OK: Uniform grains with no crystal-free area. NG: Other than OK

**OK: Swollen width (one-side) is 2.5 mm or less. NG: Other than OK

***$|Ra - Ra'|/Ra > 0.05$ . . . (1)

****Not measured.

The invention claimed is:

1. A high-strength steel tube having excellent chemical conversion treatability and excellent formability, manufactured by processing a mother steel sheet into a pipe shape by roll forming, the steel sheet having a composition containing, on the basis of mass percent, 0.05% or more C, more than 0.7% Si, and 0.8% or more Mn, wherein the sum total of absolute circumferential surface strains each applied to a surface layer of the steel tube in individual process steps of the processing is 5% or more as nominal strain.

2. The high-strength steel tube having excellent formability according to claim 1, wherein the sum total of absolute circumferential surface strains is the sum total of absolute circumferential surface strains and absolute longitudinal surface strains.

3. The high-strength steel tube having excellent formability according to claim 1, wherein the sum total of absolute circumferential surface strains each applied in individual process steps of the processing is the sum total of the absolute value of the ratio of a thickness t to an outer diameter D of the steel tube, t/D×100(%), and the absolute value of reduction rate (%) in diameter-reduction-based straightening.

4. The high-strength steel tube having excellent formability according to claim 1, wherein the mother sheet is an annealed steel sheet.

5. The high-strength steel tube having excellent formability according to claim 1, wherein the composition contains, on the basis of mass percent, 0.05% or more C, 1% or more Si, and 1.5% or more Mn.

6. A method for manufacturing a high-strength steel tube having excellent chemical conversion treatability and excellent formability, comprising processing a mother steel sheet into a pipe shape by roil forming, the steel sheet having a composition containing, on the basis of mass percent, 0.05% or more C, more than 0.7% Si, and 0.8% or more Mn, wherein each process step of the processing is controlled such that the sum total of absolute circumferential surface strains each applied to a surface layer of the steel tube in one of the process steps of the processing is 5% or more as nominal strain.

7. The method for manufacturing a high-strength steel tube having excellent formability according to claim 6, wherein the sum total of absolute circumferential surface strains is the sum total of absolute circumferential surface strains and absolute longitudinal surface strains.

8. The method for manufacturing a high-strength steel tube having excellent formability according to claim 6, wherein the process steps of the processing include altering a sheet shape or a strip shape into an open pipe shape by roll forming, joining both end faces of the open pipe shape, and straightening the cross-sectional shape of a tube, and optionally straightening a bend of the tube.

9. The method for manufacturing a high-strength steel tube having excellent formability according to claim 6, wherein the sum total of absolute circumferential surface strains each applied in individual process steps of the processing is the sum total of the absolute value of the ratio of a thickness t to an outer diameter D of the steel tube, t/D×100(%), and the absolute value of reduction rate (%) in diameter-reduction-based straightening.

10. The method for manufacturing a high-strength steel tube having excellent formability according to claim 8, wherein the altering step is performed with a cage roll method.

11. The method for manufacturing a high-strength steel tube having excellent formability according to claim 6, wherein the mother sheet is an annealed steel sheet.

12. The method for manufacturing a high-strength steel tube having excellent formability according to claim 6, wherein the composition contains, on the basis of mass percent, 0.05% or more C, 1% or more Si, and 1.5% or more Mn.

* * * * *

UNITED STATES PATENT AND TRADEMARK OFFICE

CERTIFICATE OF CORRECTION

PATENT NO. : 8,608,871 B2
APPLICATION NO. : 13/123087
DATED : December 17, 2013
INVENTOR(S) : Ishiguro et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 41 days.

Signed and Sealed this
Twenty-second Day of September, 2015

Michelle K. Lee

Michelle K. Lee
*Director of the United States Patent and Trademark Office*